US010501819B2

(12) United States Patent
Matsumoto et al.

(10) Patent No.: US 10,501,819 B2
(45) **Date of Patent: *Dec. 10, 2019**

(54) HIGH-STRENGTH AUSTENITIC STAINLESS STEEL HAVING EXCELLENT HYDROGEN EMBRITTLEMENT RESISTANCE CHARACTERISTICS AND METHOD FOR PRODUCING SAME

(71) Applicant: NIPPON STEEL & SUMIKIN STAINLESS STEEL CORPORATION, Tokyo (JP)

(72) Inventors: Kazuhisa Matsumoto, Hikari (JP); Masaharu Hatano, Hikari (JP); Shinichi Ohmiya, Kisarazu (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 203 days.

This patent is subject to a terminal disclaimer.

(21) Appl. No.: 15/553,514

(22) PCT Filed: Feb. 19, 2016

(86) PCT No.: PCT/JP2016/054900

§ 371 (c)(1),
(2) Date: Aug. 24, 2017

(87) PCT Pub. No.: WO2016/143486

PCT Pub. Date: Sep. 15, 2016

(65) Prior Publication Data

US 2018/0030566 A1 Feb. 1, 2018

(30) Foreign Application Priority Data

Mar. 6, 2015 (JP) ..... 2015-044644

(51) Int. Cl.

| | |
|---|---|
| ***C21D 9/46*** | (2006.01) |
| ***C21D 6/00*** | (2006.01) |
| ***C22C 38/58*** | (2006.01) |
| ***C21D 8/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C21D 9/46* (2013.01); *C21D 6/00* (2013.01); *C21D 6/004* (2013.01); *C21D 6/005* (2013.01); *C21D 6/008* (2013.01); *C21D 8/00* (2013.01); *C21D 8/0205* (2013.01); *C21D 8/0226* (2013.01); *C22C 38/00* (2013.01); *C22C 38/001* (2013.01); *C22C 38/002* (2013.01); *C22C 38/005* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01)

(58) Field of Classification Search

CPC .... C21D 2211/001; C21D 6/00; C21D 6/004; C21D 6/005; C21D 6/008; C21D 8/00; C21D 8/0205; C21D 8/0226; C21D 9/46; C22C 38/00; C22C 38/001; C22C 38/002; C22C 38/005; C22C 38/02; C22C 38/06; C22C 38/42; C22C 38/44; C22C 38/46; C22C 38/48; C22C 38/50; C22C 38/54; C22C 38/58

See application file for complete search history.

(56) References Cited

U.S. PATENT DOCUMENTS

| | | | |
|---|---|---|---|
| 2002/0102178 | A1 | 8/2002 | Hiramatsu et al. |
| 2003/0021716 | A1 | 1/2003 | Hauser et al. |
| 2004/0234408 | A1 | 11/2004 | Semba et al. |
| 2006/0193743 | A1 | 8/2006 | Semba et al. |
| 2009/0159602 | A1 | 6/2009 | Hatano et al. |
| 2012/0222781 | A1 | 9/2012 | Azuma et al. |

(Continued)

FOREIGN PATENT DOCUMENTS

| | | |
|---|---|---|
| EP | 1 605 073 A1 | 12/2005 |
| EP | 1645649 A1 | 4/2006 |

(Continued)

OTHER PUBLICATIONS

U.S. Office Action (Restriction/Election) for U.S. Appl. No. 15/078,562, dated Feb. 26, 2019.

(Continued)

*Primary Examiner* — Jenny R Wu

(74) *Attorney, Agent, or Firm* — Birch, Stewart, Kolasch & Birch, LLP

(57) ABSTRACT

This high-strength austenitic stainless steel having excellent hydrogen embrittlement resistance characteristics includes, by mass %, C: 0.2% or less, Si: 0.3% to 1.5%, Mn: 7.0% to 11.0%, P: 0.06% or less, S: 0.008% or less, Ni: 5.0% to 10.0%, Cr: 14.0% to 20.0%, Cu: 1.0% to 5.0%, N: 0.01% to 0.4%, and 0: 0.015% or less, with the balance being Fe and unavoidable impurities, wherein an average size of Cr-based carbonitrides is 100 nm or less, and an amount of the Cr-based carbonitrides is 0.001% to 0.5% in terms of % by mass.

6 Claims, No Drawings

(56) References Cited

U.S. PATENT DOCUMENTS

| | | | |
|---|---|---|---|
| 2013/0174949 | A1 | 7/2013 | Hatano et al. |
| 2014/0017111 | A1 | 1/2014 | Omura et al. |

FOREIGN PATENT DOCUMENTS

| | | | |
|---|---|---|---|
| EP | 1944385 | A1 | 7/2008 |
| EP | 2 460 904 | A2 | 6/2012 |
| EP | 102639739 | A | 8/2012 |
| EP | 2623624 | A1 | 8/2013 |
| EP | 2692886 | A1 | 2/2014 |
| GB | 995068 | A | 6/1965 |
| JP | 62-80221 | A | 4/1987 |
| JP | 7-70701 | A | 3/1995 |
| JP | 2002-173742 | A | 6/2002 |
| JP | 2002-371339 | A | 12/2002 |
| JP | 2003-89855 | A | 3/2003 |
| JP | 2004-323937 | A | 11/2004 |
| JP | 2005-154890 | A | 6/2005 |
| JP | 2007-126688 | A | 5/2007 |
| JP | 2009-133001 | A | 6/2009 |
| JP | 2011-26650 | A | 2/2011 |
| JP | 5131794 | B2 | 1/2013 |
| JP | 2014-1422 | A | 1/2014 |
| JP | 2014-47409 | A | 3/2014 |
| KR | 10-2011-0004491 | A | 1/2011 |
| KR | 10-2013-0045931 | A | 5/2013 |
| KR | 10-2013-0121981 | A | 11/2013 |
| WO | WO 2004/083477 | A1 | 9/2004 |
| WO | WO 2004/111285 | A1 | 12/2004 |
| WO | WO 2012/132992 | A1 | 10/2012 |

OTHER PUBLICATIONS

U.S. Office Action for U.S. Appl. No. 15/078,562, dated May 17, 2019.

Fukuyama et al., "Effect of Temperature on Hydrogen Environment Embrittlement of Type 316 Series Austenitic Stainless Steels at Low Temperatures", Journal of the Japan Institute of Metals, 2003, vol. 67, No. 9, pp. 456-459, total 5 pages.

International Search Report for PCT/JP2016/054900 dated May 17, 2016.

Written Opinion of the International Searching Authority for PCT/JP2016/054900 (PCT/ISA/237) dated May 17, 2016.

Chinese Office Action and Search Report, dated Jul. 4, 2018 for corresponding Chinese Application No. 201680012710.3, with a partial English translation of the Chinese Search Report.

Extended European Search Report for counterpart European Application No. 16761458.5 dated Nov. 22, 2018.

Korean Notice of Allowance, dated Jan. 4, 2019, for counterpart Korean Application No. 10-2017-7023555, with an English translation.

Japanese Office Action, dated Oct. 1, 2019 for Japanese Application No. 2016-057076, with English translation.

HIGH-STRENGTH AUSTENITIC STAINLESS STEEL HAVING EXCELLENT HYDROGEN EMBRITTLEMENT RESISTANCE CHARACTERISTICS AND METHOD FOR PRODUCING SAME

TECHNICAL FIELD

The present invention relates to a high-strength austenitic stainless steel having excellent hydrogen embrittlement resistance characteristics (resistance to hydrogen embrittlement) and a method for producing the same. In particular, the present invention relates to a high-strength austenitic stainless steel which is used in a high pressure hydrogen gas and liquid hydrogen environment and has excellent hydrogen embrittlement resistance characteristics, and a method for producing the same.

The present application claims priority on Japanese Patent Application No. 2015-044644 filed on Mar. 6, 2015, the contents of which are incorporated herein by reference.

BACKGROUND ART

In recent years, from a viewpoint of preventing global warming, a technology which utilizes hydrogen as a medium for transporting or storing energy has been developed in order to reduce the discharging of greenhouse gases ($CO_2$, $NO_x$, and $SO_x$). Thus, development of a metal material used for devices for storing and transporting hydrogen is expected.

In the related art, a cylinder made of thick (thickness is large) Cr—Mo steel is filled or stored with a hydrogen gas having a pressure of about 40 MPa as a high pressure gas. In addition, a SUS316 type austenitic stainless steel (hereinafter, referred to as "SUS316 steel") of the Japanese Industrial Standards is used as a piping material or a high pressure hydrogen gas tank liner of a fuel-cell vehicle. The hydrogen embrittlement resistance characteristics of the SUS316 steel in a high pressure hydrogen gas environment is more satisfactory than, for example, a carbon steel including the aforementioned Cr—Mo steel or SUS304 type austenitic stainless steel (hereinafter, referred to as "SUS304 steel") of the Japanese Industrial Standards.

In recent years, prior to general sales of fuel-cell vehicles, an official trial production or demonstration experiment of a hydrogen station has been in progress. For example, a hydrogen station, in which a large amount of hydrogen can be stored as liquid hydrogen and the pressure of the liquid hydrogen is increased to supply a high pressure hydrogen gas having a pressure of 70 MPa or greater, is in the demonstration (validation) phase. In addition, in the hydrogen station, a technology, which is referred to as precooling, has been practically used, and in the technology, hydrogen which is to be filled in a tank of the fuel-cell vehicle is pre-cooled to a low temperature of about −40° C. From the above-circumstances, it is conceived that a metal material used for a storage container for liquid hydrogen attached to a dispenser of the hydrogen station or hydrogen gas piping is exposed to a hydrogen gas having a high pressure of 70 MPa and a low temperature.

As a metal material in which hydrogen embrittlement does not occur in a severe hydrogen embrittlement environment, the SUS316 steel and SUS316L steel containing about 13% of Ni are exemplary examples. Use of these two types of steels in a 70 MPa-class hydrogen station in Japan is permitted by the standards determined by the High Pressure Gas Safety Institute of Japan.

Meanwhile, in order to construct and autonomously develop a hydrogen energy society where a fuel-cell vehicle is mainly used in the future, it is essential to reduce the cost of fuel-cell vehicles or hydrogen stations. That is, in order to reduce the use amount of the steel material caused by the reduction in size and thickness of various devices, the strength of the metal material used in a hydrogen embrittlement environment is required to be further increased.

However, the SUS316 type austenitic stainless steel described in the aforementioned exemplified standard is expensive since the SUS316 type austenitic stainless steel includes a large amount of Ni and Mo, which are rare metals. Furthermore, a tensile strength of about 650 MPa is required to be used for the purpose of high pressure hydrogen piping. However, even in the case where the SUS316 type austenitic stainless steel is subjected to a solutionizing treatment, the SUS316 type austenitic stainless steel does not satisfy the above tensile strength. Thus, the SUS316 type austenitic stainless steel is subjected to cold working to reinforce the strength and is then used.

Patent Document 1 (Japanese Unexamined Patent Application, First Publication No. 2002-371339) discloses a stainless steel including 5% to 9% of Ni, which is low, and having a low cost.

In a stainless steel disclosed in Patent Document 2 (Japanese Unexamined Patent Application, First Publication No. 2002-173742), the metallographic structure (metal structure, microstructure) is controlled to have a dual phase structure of an austenite phase and a martensite phase by a thermo-mechanical treatment, while the amount of Ni is set to 4% to 12%. Thereby, a remarkably hard stainless steel is achieved which has a Vickers hardness of about 500.

The stainless steel disclosed in Patent Document 3 (PCT International Publication No. WO 2004/83477) is a stainless steel for a high pressure hydrogen gas, which is aiming for increasing the strength by solid solution strengthening of N. This stainless steel has the strength higher than the strength of SUS316 steel, while satisfactory hydrogen embrittlement resistance characteristics are secured.

In the stainless steel disclosed in Patent Document 4 (Japanese Unexamined Patent Application, First Publication No. 2009-133001), hydrogen embrittlement resistance characteristics are enhanced by utilizing carbonitrides of Ti and Nb having sizes of 1 μm or greater, and the stainless steel is economically excellent since addition of Mo to the SUS 316 steel is omitted.

However, the stainless steel disclosed in Patent Document 1 has almost the same strength as that of the SUS316 steel, and the use of the stainless steel in a hydrogen environment is not considered.

In addition, since the stainless steel disclosed in Patent Document 2 includes a martensite phase in which hydrogen embrittlement easily occurs, it is difficult to apply this stainless steel in a hydrogen environment.

In addition, the stainless steel disclosed in Patent Document 3 substantially includes Ni at an amount of 10% or more, and in the case where the amount of Ni is reduced to less than the above-described amount, it is required to add Mo, Nb, V, or Nd; and as a result, the cost becomes high.

In addition, the stainless steel disclosed in Patent Document 4 has almost the same strength as that of SUS316 steel, and enhancement of the strength is further desired.

As such, currently, a high-strength austenitic stainless steel has not appeared yet, which has both economic properties and hydrogen embrittlement resistance characteristics in a low temperature and a high pressure hydrogen gas environment exceeding 40 MPa.

PRIOR ART DOCUMENTS

Patent Documents

Patent Document 1: Japanese Unexamined Patent Application, First Publication No. 2002-371339

Patent Document 2: Japanese Unexamined Patent Application, First Publication No. 2002-173742

Patent Document 3: PCT International Publication No. WO 2004/83477

Patent Document 4: Japanese Unexamined Patent Application, First Publication No. 2009-133001

Patent Document 5: Japanese Unexamined Patent Application, First Publication No. 2014-47409

Patent Document 6: Japanese Unexamined Patent Application, First Publication No. 2014-1422

Non-Patent Document

Non-Patent Document 1: Journal of the Japan Institute of Metals, "Effect of Temperature on Hydrogen Environment Embrittlement of Type 316 Series Austenitic Stainless Steels at Low Temperatures" Vol. 67, No. 9 (2003), pp. 456 to 459

DISCLOSURE OF THE INVENTION

Problems to be Solved by the Invention

The present invention has been made in consideration of the aforementioned circumstances and has an object of providing a high-strength austenitic stainless steel having excellent hydrogen embrittlement resistance characteristics, which can be suitably used in a low temperature and high pressure hydrogen gas environment exceeding 40 MPa.

Means for Solving the Problem

For example, Patent Document 5 (Japanese Unexamined Patent Application, First Publication No. 2014-47409) discloses a stainless steel for high pressure hydrogen aimed to increase the strength by precipitation strengthening.

The stainless steel disclosed in Patent Document 5 utilizes η phase intermetallic compound. However, this requires addition of Ni at an amount of 20% or more and causes an increase in alloy cost.

Therefore, the present inventors paid attention to Cr-based carbonitrides as precipitates obtainable by utilizing a major element.

Meanwhile, in general, various properties of the stainless steel are degraded by the influence of the Cr-based carbonitrides. For example, as disclosed in Patent Document 6 (Japanese Unexamined Patent Application, First Publication No. 2014-1422), if the Cr-based carbonitrides are precipitated, an interface between the Cr-based carbonitride and a matrix phase becomes a starting point of destruction, which causes degradation of formability.

Further, the influence of the Cr-based carbonitride on the hydrogen gas embrittlement resistance characteristics of the stainless steel is not exceptional.

According to Non-Patent Document 1, in the case where the Cr-based carbonitrides are precipitated in the metallographic structure, a Cr-depletion layer in which the Cr concentration is remarkably decreased is formed in the surroundings of this precipitate. Since stability of the austenite phase is decreased at or in the vicinity of this Cr-depletion layer, a deformation-induced martensite phase is generated preferentially at the time of deformation, and this causes degradation in ductility in the high pressure hydrogen gas. The Cr depletion layer can be eliminated by additionally performing a heat treatment to diffuse Cr atoms, but the production cost increases.

Herein, the present inventors have thoroughly studied a relationship between an alloy component composition of the austenitic stainless steel including Cr, Mn, Ni, and Mo, which are major elements, and trace elements, and a metallographic structure (metal structure, microstructure), an average size of the Cr-based carbonitrides, hydrogen embrittlement resistance characteristics in a high pressure hydrogen gas environment and strength. As a result, the following new findings (a) to (e) are obtained.

(a) In the specimen in which hydrogen embrittlement has occurred, cracks are generated in the vicinity of the Cr-based carbonitride. Connection and propagation of the cracks generated in the vicinity of each Cr-based carbonitride degrade ductility.

(b) However, by controlling the average size of the Cr-based carbonitrides to 100 nm or less and controlling the amount of the Cr-based carbonitrides to 0.001% to 0.5% in terms of mass%, generation and development of the cracks due to hydrogen embrittlement are remarkably reduced; and as a result, hydrogen embrittlement resistance characteristics are enhanced.

(c) If the average size and the amount (mass %) of the Cr-based carbonitrides are satisfied as described above, high strength of the austenitic stainless steel containing the Cr-based carbonitride is effectively achieved. Furthermore, due to a multiple action of precipitation strengthening of the Cr-based carbonitrides and utilization of solid solution strengthening of N by the addition of Mn, it is possible to obtain tensile strength of about 700 MPa, which is more than that of the cold-worked material of SUS316 steel.

(d) The size of the Cr-based carbonitride is strongly influenced by heat treatment conditions. A precipitation nose temperature of the Cr-based carbonitride is about 800° C. If a steel material is held at a temperature of higher than 800° C., the Cr-based carbonitrides are precipitated in a short period of time, and coarsening rapidly proceeds. Thus, it is difficult to control the average size of the Cr-based carbonitrides to 100 nm or less. If the steel material is held at a temperature of equal to or lower than 800° C., coarsening of the Cr-based carbonitrides can be prevented, but it takes time until the precipitation is started, and this leads to an increase in production cost.

(e) However, at the time of cooling after the final heat treatment, by controlling an average cooling rate to less than 2.0° C/s until the temperature reaches 750° , it is possible to secure the amount (mass %) and the average size of the Cr-based carbonitrides, which enables enhancement of both high strength and hydrogen embrittlement resistance characteristics of the stainless steel.

One aspect of the present invention has been made based on the aforementioned new findings (a) to (e) and the features thereof are as follows.

(1) A high-strength austenitic stainless steel having excellent hydrogen embrittlement resistance characteristics includes, in terms of % by mass: C: 0.2% or less; Si: 0.3% to 1.5%; Mn: 7.0% to 11.0%; P: 0.06% or less; 5: 0.008% or less; Ni: 5.0% to 10.0%; Cr: 14.0% to 20.0%; Cu: 1.0% to 5.0%; N: 0.01% to 0.4%; and O: 0.015% or less, with the balance being Fe and unavoidable impurities, wherein an average size of Cr-based carbonitrides is 100 nm or less and an amount of the Cr-based carbonitrides is 0.001% to 0.5% in terms of % by mass.

(2) The high-strength austenitic stainless steel having excellent hydrogen embrittlement resistance characteristics according to (1), further includes, in terms of % by mass, Mo: 0.5% or less.

(3) The high-strength austenitic stainless steel having excellent hydrogen embrittlement resistance characteristics according to (1) or (2), further includes, in terms of % by mass, one or more selected from Al: 0.3% or less, Mg: 0.01% or less, Ca: 0.01% or less, REM: 0.10% or less, and B: 0.005% or less.

(4) The high-strength austenitic stainless steel having excellent hydrogen embrittlement resistance characteristics according to any one of (1) to (3), further includes, in terms of % by mass, one or more selected from Ti: 0.5% or less, Nb: 0.5% or less, and V: 0.5% or less.

(5) The high-strength austenitic stainless steel having excellent hydrogen embrittlement resistance characteristics according to any one of (1) to (4) is used in a high pressure hydrogen gas and liquid hydrogen environment.

(6) A method for producing a high-strength austenitic stainless steel having excellent hydrogen embrittlement resistance characteristics, the method includes a step of hot-working a semi-finished product having a component composition according to any one of (1) to (4); a step of performing a final heat treatment at a temperature of 1000° C. to 1150° C.; and a step of performing cooling after the final heat treatment, wherein in the cooling step, an average cooling rate is controlled to be less than 2.0° C/s until the temperature reaches 750° C.

Effects of the Invention

According to the one aspect of the present invention, it is possible to provide a high-strength austenitic stainless steel which has excellent hydrogen embrittlement resistance characteristics and is suitably used in a high pressure hydrogen gas and liquid hydrogen environment, and a method for producing the same.

EMBODIMENTS FOR CARRYING OUT THE INVENTION

Hereinafter, the austenitic stainless steel and the method for producing the same according to the embodiment will be described in detail.

First, the component composition of the austenitic stainless steel according to the embodiment will be described. In addition, in the following description, the "%" indicating the amount of each element means "mass%".

The austenitic stainless steel according to the embodiment includes, by mass %, C: 0.2% or less, Si: 0.3% to 1.5%, Mn: 7.0% to 11.0%, P: 0.06% or less, S: 0.008% or less, Ni: 5.0% to 10.0%, Cr: 14.0% to 20.0%, Cu: 1.0% to 5.0%, N: 0.01% to 0.4%, and O: 0.015% or less. Further, the average size of Cr-based carbonitrides is 100 nm or less, and the amount of the Cr-based carbonitrides is 0.001 to 0.5% in terms of % by mass.

In below, first of all, a reason for limiting the component composition will be described.

<C: 0.2% or Less>

C is an element effective for stabilizing an austenite phase and C contributes to enhancing hydrogen embrittlement resistance characteristics. In addition, due to solid solution strengthening and precipitation strengthening of Cr-based carbides, C also contributes to an increase in strength. In order to obtain these effects, it is preferable to set the amount of C to 0.01% or more. Meanwhile, an excessive amount of C causes excessive precipitation of Cr-based carbides and this leads to degradation of hydrogen embrittlement resistance characteristics. Therefore, it is necessary to set the upper limit of the amount of C to 0.2%. The upper limit of the amount of C is more preferably 0.15%.

<Si: 0.3% to 1.5%>

Si is an element effective for stabilizing the austenite phase. It is necessary to set the amount of Si to 0.3% or more in order to enhance hydrogen embrittlement resistance characteristics by stabilizing the austenite phase. The amount of Si is preferably 0.4% or more. Meanwhile, an excessive amount of Si promotes generation of intermetallic compounds such as a sigma phase and this causes degradation of hot workability or toughness. Therefore, it is necessary to set the upper limit of the amount of Si to 1.5%. The amount of Si is more preferably 1.1% or less.

<Mn: 7.0% to 11.0%>

Mn is an element effective for stabilizing the austenite phase. Due to the stabilization of the austenite phase, generation of deformation-induced martensite phase is prevented; and thereby, hydrogen embrittlement resistance characteristics are improved. Therefore, it is necessary to set the amount of Mn to 7.0% or more. The amount of Mn is preferably 7.5% or more. Meanwhile, an excessive amount of Mn promotes generation of a 6 ferrite phase, which becomes a starting point of breakage caused by hydrogen embrittlement. Accordingly, it is necessary to set the upper limit of the amount of Mn to 11.0%. The amount of Mn is more preferably 10.5% or less.

<P: 0.06% or Less>

P is included as an impurity in the austenitic stainless steel of the embodiment. Since P is an element degrading hot workability, it is preferable to reduce the amount of P as much as possible. Specifically, it is preferable to limit the amount of P to 0.06% or less and more preferable to limit the amount thereof to 0.05% or less. However, since an extreme reduction in the amount of P leads to an increase in steel production cost, the amount of P is preferably 0.008% or more.

<S: 0.008% or Less>

S is segregated in the austenite grain boundary at the time of hot working and S weakens bonding strength of the grain boundary. As a result, S becomes an element inducing breakage at the time of hot working. Therefore, it is necessary to limit the upper limit of the amount of S to 0.008%. The upper limit of the amount of S is preferably 0.005%. Since it is preferable to reduce the amount of S as much as possible, the lower limit is not particularly provided; however, an extreme reduction in the amount of S leads to an increase in steel production cost. Therefore, the amount of S is preferably 0.0001% or more.

<Ni: 5.0% to 10.0%>

Ni is an element very effective for enhancing hydrogen embrittlement resistance characteristics of the austenitic stainless steel. In order to obtain this effect, it is necessary to set the amount of Ni to 5.0% or more. The amount of Ni is preferably 5.5% or more. Meanwhile, since an excessive amount of Ni causes an increase in material cost, the upper limit of the amount of Ni is set to 10.0%. The amount of Ni is preferably 9.5% or less.

<Cr: 14.0% to 20.0%>

Cr is an indispensable element for obtaining corrosion resistance required for a stainless steel. In addition, Cr is an element contributing to an increase in strength of the austenitic stainless steel. In order to secure corrosion resistance equivalent to that of the conventional SUS316 steel in a general corrosion environment, it is necessary to set the amount of Cr to 14.0% or more. The amount of Cr is preferably 14.5% or more. Meanwhile, an excessive amount of Cr causes excessive precipitation of Cr-based carbonitrides, and this degrades hydrogen embrittlement resistance characteristics. Therefore, it is necessary to set the upper limit of the amount of Cr to 20.0%. The amount of Cr is preferably 18.5% or less.

<Cu: 1.0% to 5.0%>

Cu is an element effective for stabilizing the austenite phase. Since stabilization of the austenite phase enhances hydrogen embrittlement resistance characteristics, it is necessary to set the amount of Cu to 1.0% or more. The amount of Cu is preferably 1.8% or more. Meanwhile, an excessive amount of Cu leads to a decrease in strength and impairs hot workability. Therefore, it is necessary to set the upper limit of the amount of Cu to 5.0%. The amount of Cu is more preferably 4.0% or less.

<N: 0.01% to 0.4%>

N is an element effective for stabilizing an austenite phase and enhancing corrosion resistance. In addition, N also contributes to an increase in strength due to solid solution strengthening and precipitation strengthening of Cr-based nitrides. In order to obtain these effects, the amount of N is preferably set to 0.01% or more. The amount of N is preferably 0.03% or more. Meanwhile, an excessive amount of N promotes excessive generation of Cr-based nitrides, and this degrades hydrogen embrittlement resistance characteristics of the austenite phase, corrosion resistance, or toughness. Therefore, it is necessary to set the upper limit of the amount of N to 0.4%. The amount of N is more preferably 0.3% or less.

<O: 0.015% or Less>

O forms oxides in the steel; and thereby, hot workability and toughness of the austenite phase are degraded. Therefore, it is necessary to limit the upper limit of the amount of O (oxygen) to 0.015% or less. The amount of O is preferably 0.010% or less. It is preferable to reduce the amount of O (oxygen) as much as possible, but an extreme reduction leads to an increase in steel production cost. Therefore, the amount of O (oxygen) is preferably 0.001% or more.

The austenitic stainless steel according to the embodiment may include optional elements described below.

<Mo: 0.5% or Less>

Mo is an element contributing to an increase in strength of the austenitic stainless steel and enhancement of the corrosion resistance. However, an addition of Mo causes an increase in alloy cost. Furthermore, in the austenitic stainless steel of the embodiment, Mo promotes generation of a δ phase, and this leads to a degradation of hydrogen embrittlement resistance characteristics. Therefore, the amount of Mo is preferably set to 0.5% or less. Meanwhile, Mo is an element which is unavoidably incorporated from a scrap material. An extreme reduction in the amount of Mo causes restriction of melting materials, and this leads to an increase in production cost. Therefore, in order to obtain both the aforementioned effects and reduction of the production cost, it is preferable to set the lower limit of the amount of Mo to 0.05%.

<Al: 0.3% or Less, Mg and Ca: 0.01% or Less, REM: 0.10% or Less, and B: 0.005% or Less>

Al, Mg, Ca, REM, and B are elements effective for deoxidization and enhancement of hot workability and corrosion resistance. If necessary, one or more elements selected from these may be added. However, an excessive amount of these elements causes a remarkable increase in production cost. Therefore, it is necessary to set the upper limits of the amounts of these elements to: Al: 0.3% or less, each of Mg and Ca: 0.01% or less, REM: 0.10% or less, and B: 0.005% or less. It is not necessary to provide the lower limits of the amounts of these elements in particular; however, in order to sufficiently obtain the deoxidization effect, it is preferable to set the lower limits of the amounts of these elements to: Al: 0.01%, each of Mg and Ca: 0.0002%, REM: 0.01%, and B: 0.0002%.

Herein, REM (rare earth element) refers to a generic term for 2 elements of scandium (Sc) and yttrium (Y), and 15 elements (lanthanoid) from lanthanum (La) to lutetium (Lu) according to the general definition. A single element may be added or two or more elements may be added. The amount of REM is the total amount of these elements.

<Ti, Nb, and V: 0.50% or Less>

Ti, Nb, and V are solid-solubilized in the steel or precipitated as carbonitrides, and Ti, Nb, and V are elements effective for increasing the strength. One or more elements selected from these may be added as necessary. In this case, each of the amounts of Ti, Nb, and V is preferably 0.01% or more. However, in the case where each of the amounts of Ti, Nb, and V is increased to more than 0.50%, these elements are precipitated and coarsened at the time of final heat treatment, and this prevents generation of Cr-based carbonitrides. Therefore, it is necessary to set the upper limit of each of the amounts of Ti, Nb, and V to 0.50% or less. The upper limit of each of the amounts of Ti, Nb, and V is preferably 0.30%.

In the austenitic stainless steel according to the embodiment, the balance other than the aforementioned elements is Fe and unavoidable impurities, and other elements excluding each element described above can be included within the range not impairing the effect of the embodiment.

"Reason for limiting precipitates (Cr-based carbonitrides)"

Next, the size and generation amount of the Cr-based carbonitrides precipitated in the steel will be described.

In the specimen where hydrogen embrittlement has occurred, cracks are generated in the surroundings of Cr-based carbonitrides. This is because hydrogen gas embrittlement resistance characteristics are locally degraded in the surroundings of each of the Cr-based carbonitrides, which are caused by the Cr-depletion layer formed in the surroundings of each of the Cr-based carbonitrides. The cracks generated from the surroundings of the Cr-based carbonitrides as starting points are connected to each other and propagated; and as a result, a decrease in ductility is caused.

However, by controlling the average size of the Cr-based carbonitrides to 100 nm or less and controlling the generation amount of the Cr-based carbonitrides to 0.5% or less in terms of mass %, generation and development of cracks which are generated by hydrogen gas embrittlement are remarkably prevented. As a result, the hydrogen gas embrittlement resistance characteristics are enhanced.

Further, due to a multiple action of solid solution strengthening of N by the addition of Mn and precipitation strengthening of Cr-based carbonitrides for increasing the strength, it is possible to obtain a tensile strength of about 700 MPa, which is more than that of the cold-worked material of SUS316 steel. In order to obtain this effect, the lower limit of the generation amount of the Cr-based carbonitrides is set to 0.001% or more. The lower limit of the generation amount of the Cr-based carbonitride is preferably 0.005% or more.

The average size of the Cr-based carbonitrides and the generation amount of the Cr-based carbonitrides can be controlled by controlling the average cooling rate of the final heat treatment as described later. Since this average cooling rate is low, the precipitates are gradually coarsened. Therefore, the presence of the Cr-based carbonitrides can be confirmed by a Transmission Electron Microscope (TEM). The average size of the Cr-based carbonitrides is 100 nm or less and preferably 70 nm or less.

Meanwhile, in the case where the average cooling rate is high (a case of being close to the upper limit), the Cr-based carbonitrides are very fine. Therefore, the lower limit of the average size of the Cr-based carbonitride is not particularly provided, and is preferably 5 nm or more.

The generation amount of Cr-based carbonitrides can be measured by, for example, an electroextraction residual method.

In the case where an excessive amount of the Cr-based carbonitrides is produced, connection and propagation of cracks which are generated from the surroundings of the Cr-based carbonitrides as starting points is promoted. Thus, it is necessary to set the generation amount of the Cr-based carbonitrides to 0.5% or less in terms of mass %. The generation amount of the Cr-based carbonitride is preferably 0.45% or less in terms of mass %. Meanwhile, in the case where the cooling rate is high (a case of being close to the upper limit), the Cr-based carbonitrides are very fine. Therefore, the lower limit of the average size of the Cr-based carbonitrides is not particularly provided. However, in order to obtain the effect of increasing the strength, the lower limit of the generation amount of the Cr-based carbonitrides is 0.001% or more and preferably 0.005% or more.

In addition, the average size of the Cr-based carbonitrides is measured by, for example, the following method. The precipitates are observed by TEM, the precipitates are identified by EDX, and the Cr-based carbonitrides are specified. Next, the major axis and the minor axis of one Cr-based carbonitride are measured by a TEM photograph. Then, the average value of the major axis and the minor axis ((major axis+minor axis)/2) is obtained to determine the size of the Cr-based carbonitride. In the same manner, the sizes of a plurality of Cr-based carbonitrides are obtained. The average value of the sizes of the plurality of Cr-based carbonitrides is calculated, and the average size thereof can be determined as the average size of the Cr-based carbonitrides in the stainless steel.

In addition, in the embodiment, a rectangle circumscribing one Cr-based carbonitride is drawn such that the area thereof becomes the smallest. Then, the long side of this circumscribing rectangle is determined as a major axis of the Cr carbonitride and the short side of this circumscribing rectangle is determined as a minor axis of the Cr carbonitride.

"Producing Method"

Next, one example of the method for producing an austenitic stainless steel according to the embodiment will be described.

For producing the austenitic stainless steel of the embodiment, first, a stainless steel having the aforementioned component composition is melted to produce a semi-finished product such as a slab. Next, the semi-finished product is heated at a predetermined temperature, and hot working such as hot rolling and the like (a step of hot working) is conducted.

In addition, the austenitic stainless steel of the embodiment is not limited to a steel sheet. Therefore, the semi-finished product is not limited to a slab, and it is needless to say that the austenitic stainless steel of the embodiment can be achieved as well even by selecting a preferable shape of the semi-finished product (billet, bloom, or the like) in accordance with the shape of the target product (bar, pipe, or the like).

Hereinafter, a condition for the final heat treatment after hot working will be described in detail.

If the temperature of the final heat treatment after hot working is too high, there may be a case where the strength of the steel material is decreased due to an excessive grain growth or a case where a grinding step is added because abnormal oxidation occurs and this may cause an increase in production cost. Therefore, the upper limit of the temperature of the final heat treatment is set to 1150° C. Meanwhile, if the temperature of the final heat treatment is too low, a deformed structure at the time of hot working remains and ductility of a steel product is decreased. Thus, the lower limit is set to 1000° C. The temperature range of the final heat treatment is preferably 1020° C. to 1120° C.

The retention time of the heat treatment in the aforementioned temperature range is set to 1 second to 1 hour. In the case where the retention time is shorter than this range, a worked structure remains in the steel, and this causes a decrease in ductility. The lower limit of the retention time is preferably 30 seconds. In addition, in the case where the retention time of the heat treatment is too long, there may be a case where the strength of the steel material is decreased due to an excessive grain growth or a case where a grinding step is added because abnormal oxidation occurs and this may cause an increase in production cost. Therefore, the upper limit of the retention time is set to 40 minutes.

The precipitation nose temperature of Cr-based carbonitride is about 800° C. In the case where the steel material is retained at a temperature higher than 800° C., the Cr-based carbonitrides are rapidly coarsened. Thus, it is difficult to control the average size of the Cr-based carbonitrides to be 100 nm or less. Meanwhile, in the case where the steel material is retained at a temperature of 800° C. or lower, the coarsening of the Cr-based carbonitrides can be prevented but it takes a time to start the precipitation. Therefore, this leads to an increase in production cost.

However, in the case where the average cooling rate is controlled to be less than 2.0° C/s until the temperature reaches 750° C. in the step of cooling after the final heat treatment at a temperature of 1000° C. to 1150° C., it is possible to secure the average size and the generation amount of Cr-based carbonitrides which can achieve a good balance between high strengthening of the stainless and improvement of hydrogen embrittlement resistance characteristics.

From the above circumstances, in the cooling step after the final heat treatment, it is necessary to control the average cooling rate to be less than 2.0° C/s until the temperature reaches 750° C. In the case where the average cooling rate is higher than 2.0° C/s, the time for which the Cr-based carbonitrides are precipitated cannot be secured.

Thus, it is not possible to increase the strength of the steel product. Meanwhile, in the case where the cooling rate is excessively low, the average size of the Cr-based carbonitrides may be greater than 100 nm and satisfactory hydrogen embrittlement resistance characteristics of the steel product may not be secured. Therefore, the lower limit of the average cooling rate is preferably 0.3° C/s or higher.

In addition, as necessary, cooling such as water cooling or standing to cool (air cooling) may be appropriately performed between the aforementioned hot working and the final heat treatment. Also, after the aforementioned hot working and the final heat treatment are performed, acid pickling or cold working may be performed as necessary.

In addition, the producing method of the austenitic stainless steel according to the embodiment is not limited to the producing method described above and any producing method may be adopted, as long as the method is a method by which the average size and the generation amount of Cr-based carbonitrides can be controlled within the aforementioned ranges.

In addition, the average size and the generation amount of Cr-based carbonitrides may be controlled within the aforementioned ranges, by a heat treatment in a step of producing a device for hydrogen in which the austenitic stainless steel satisfying the component composition of the embodiment is utilized, or a heat treatment performing on the device for hydrogen.

EXAMPLES

Examples of the invention will be described below, but the invention is not limited to conditions used in the following Examples.

In addition, the underlined values in Tables indicate that they are out of the ranges of the embodiment.

A test material of stainless steel having a component composition shown in Table 1 was melted to produce a slab having a thickness of 120 mm. Next, the slab was heated at a temperature of 1200° C. to perform hot rolling; and thereby, a hot-rolled sheet having a thickness of 20 mm was produced. Next, the hot-rolled sheet was subjected to the final heat treatment and cooling under conditions shown in Table 2 to obtain a hot rolled and annealed sheet. The retention time for the final heat treatment was within a range of 3 minutes to 20 minutes. The "heat treatment temperature (° C.)" in Table 2 indicates the temperature of the final heat treatment and the "cooling rate (° C/s)" indicates the average cooling rate.

The average size of the Cr-based carbonitrides and the amount of the Cr-based carbonitrides of each test material are shown in Table 2.

A sample was fabricated from the obtained hot rolled and annealed sheet by an extraction replica method, and then precipitates were observed by TEM and the precipitates were identified by EDX; and thereby, Cr-based carbonitrides were specified. The size of one Cr-based carbonitride was defined as an average value of the major axis and the minor axis ((major axis+minor axis)/2). The sizes were measured with respect to 30 (pieces of) Cr-based carbonitrides, and the average value of the sizes of the 30 Cr-based carbonitrides was determined as the average size of the Cr-based carbonitrides in the test material.

An analysis sample was collected from the test material in the same manner, and the amount of the precipitates (amount of the Cr-based carbonitrides) was measured by the electro-extraction residual method. The filter with a mesh size of 0.2 μm was used to filter a residual and a detection amount of Cr was considered to be the amount of Cr-based carbonitrides of the test material.

Next, hydrogen gas embrittlement resistance characteristics of each test material of the hot rolled and annealed sheet were evaluated by the method shown below.

A round bar tensile specimen having a parallel part with an outer diameter of 3 mm and a length of 20 mm was collected from a central part of the sheet thickness in a longitudinal direction of the hot rolled and annealed sheet having a thickness of 20 mm. A tensile test (1) in the atmosphere and a tensile test (2) in the high pressure hydrogen gas were performed using this round bar tensile specimen.

The tensile test (1) in the atmosphere was conducted under conditions where the test temperature was 25° C., the test environment was atmosphere, and the strain rate was $5\times10^{-5}$/s.

The tensile test (2) in the high pressure hydrogen gas was conducted in the same manner as the tensile test (1) in the atmosphere except that the test environment was a "hydrogen gas of 70 MPa".

In addition, the test material of which the tensile strength exceeded 650 MPa in the atmosphere and a hydrogen gas of 70 MPa was evaluated as "Pass".

Furthermore, the value of "(reduction of area in the high pressure hydrogen gas/reduction of area in the atmosphere)× 100 (%)" was calculated as a relative reduction of area. The test material of which the value was 80% or more was evaluated such that hydrogen embrittlement resistance characteristics in the high pressure hydrogen gas were "Pass". The results thereof are shown in Table 3.

The specimens A1a and A2 to A17 are test materials (Invention Examples) obtained by conducting the final heat treatment and cooling under preferable conditions. The tensile strengths of in the atmosphere and in the hydrogen of 70 MPa were more than 650 MPa, which is a target value, while the relative reduction of area thereof was 90% or more.

In the specimen A1b, the cooling rate after the final heat treatment was more than the range of the embodiment. As a result, Cr-based carbonitrides were not precipitated in the test material at the time of cooling after the final heat treatment and the effect of precipitation strengthening could not be obtained. Thus, the tensile strength in the atmosphere was less than 650 MPa.

In the specimen B1, the amount of Cu was less than the range of the embodiment. As a result, hydrogen embrittlement resistance characteristics were insufficient and the relative reduction of area was 56%.

In the specimen B2, the amount of Cu was more than the range of the embodiment. As a result, the strength of the austenite phase was decreased and the tensile strengths in the atmosphere and in the hydrogen of 70 MPa were less than 650 MPa, which is the target value.

In the specimen B3, the amount of Ni was less than the range of the embodiment. As a result, hydrogen embrittlement resistance characteristics were insufficient and the relative reduction of area was 48%.

In the specimen B4, the amount of N was more than the range of the embodiment. As a result, the deformed structure of the austenite phase became a structure having high sensitivity of hydrogen gas embrittlement, the hydrogen embrittlement resistance characteristics were insufficient, and the relative reduction of area was 51%.

In the specimen B5, the amount of Mn was less than the range of the embodiment. As a result, hydrogen embrittlement resistance characteristics were insufficient and the relative reduction of area was 56%.

In the specimen B6, the amount of Mn was more than the range of the embodiment. As a result, δ ferrite phases were remained in austenite phases; and thereby, hydrogen embrittlement resistance characteristics were insufficient and the relative reduction of area was 58%.

In the specimen B7, the amount of N was less than the range of the embodiment. As a result, the effect of solid solution strengthening could not be sufficiently obtained, the strength of the austenite phase was insufficient, and the tensile strengths in the atmosphere and the hydrogen of 70 MPa could not be more than the target value.

TABLE 1

| Steel No. | Component Composition (mass %) | | | | | | | | | | | Remarks |
|---|---|---|---|---|---|---|---|---|---|---|---|---|
| | C | Si | Mn | P | S | Ni | Cr | Cu | N | O | Others | |
| A1 | 0.09 | 0.49 | 8.3 | 0.037 | 0.004 | 7.2 | 16.8 | 2.8 | 0.22 | 0.009 | | Invention steels |
| A2 | 0.18 | 0.49 | 8.3 | 0.038 | 0.004 | 7.2 | 16.9 | 2.7 | 0.21 | 0.008 | | |
| A3 | 0.08 | 0.48 | 8.1 | 0.034 | 0.004 | 7.2 | 16.7 | 2.7 | 0.03 | 0.009 | | |
| A4 | 0.10 | 0.50 | 8.4 | 0.036 | 0.005 | 7.1 | 17.1 | 2.7 | 0.32 | 0.009 | | |
| A5 | 0.11 | 0.52 | 8.5 | 0.037 | 0.004 | 5.5 | 16.6 | 2.9 | 0.23 | 0.011 | | |
| A6 | 0.09 | 0.49 | 8.4 | 0.035 | 0.003 | 9.3 | 16.8 | 2.7 | 0.24 | 0.009 | | |
| A7 | 0.06 | 0.51 | 8.8 | 0.037 | 0.004 | 7.2 | 15.2 | 2.6 | 0.23 | 0.007 | | |
| A8 | 0.08 | 0.49 | 8.7 | 0.039 | 0.005 | 7.3 | 18.7 | 2.5 | 0.25 | 0.009 | | |
| A9 | 0.09 | 0.49 | 8.3 | 0.037 | 0.004 | 7.2 | 16.8 | 2.8 | 0.22 | 0.012 | Mo: 0.34 | |
| A10 | 0.12 | 0.49 | 8.4 | 0.033 | 0.004 | 7.2 | 17.0 | 2.7 | 0.24 | 0.009 | Al: 0.055, Ca: 0.0035, B: 0.0013 | |
| A11 | 0.10 | 0.51 | 8.4 | 0.034 | 0.005 | 7.1 | 16.8 | 2.8 | 0.21 | 0.009 | Mg: 0.004, Ca: 0.0029 | |
| A12 | 0.12 | 0.49 | 8.4 | 0.033 | 0.004 | 7.2 | 17.0 | 2.7 | 0.24 | 0.011 | REM: 0.024 | |
| A13 | 0.10 | 0.51 | 8.4 | 0.034 | 0.005 | 7.1 | 16.8 | 2.8 | 0.21 | 0.009 | Ti: 0.11, Nb: 0.09, V: 0.13 | |
| A14 | 0.09 | 0.49 | 8.3 | 0.037 | 0.004 | 7.2 | 16.8 | 2.8 | 0.22 | 0.010 | Ti: 0.19 | |
| A15 | 0.12 | 0.49 | 8.4 | 0.033 | 0.004 | 7.2 | 17.0 | 2.7 | 0.24 | 0.009 | Nb: 0.22 | |
| A16 | 0.10 | 0.51 | 8.4 | 0.034 | 0.005 | 7.1 | 16.8 | 2.8 | 0.21 | 0.009 | V: 0.18 | |
| A17 | 0.14 | 0.61 | 9.0 | 0.024 | 0.005 | 6.9 | 18.1 | 2.5 | 0.11 | 0.012 | | |
| B1 | 0.11 | 0.45 | 8.9 | 0.037 | 0.004 | 6.9 | 16.7 | 0.7 | 0.25 | 0.008 | | Comparative steels |
| B2 | 0.12 | 0.49 | 8.8 | 0.034 | 0.006 | 7.0 | 16.8 | 5.2 | 0.24 | 0.009 | Al: 0.047, Ca: 0.0031, B: 0.0016 | |
| B3 | 0.10 | 0.51 | 8.5 | 0.034 | 0.005 | 4.4 | 17.2 | 2.8 | 0.21 | 0.013 | | |
| B4 | 0.10 | 0.50 | 8.4 | 0.036 | 0.005 | 7.1 | 17.1 | 2.7 | 0.42 | 0.010 | | |
| B5 | 0.12 | 0.49 | 6.3 | 0.033 | 0.004 | 6.8 | 17.1 | 2.7 | 0.20 | 0.009 | | |
| B6 | 0.13 | 0.44 | 11.3 | 0.041 | 0.004 | 6.8 | 17.0 | 2.7 | 0.25 | 0.006 | | |
| B7 | 0.009 | 0.52 | 8.1 | 0.038 | 0.003 | 6.9 | 16.9 | 2.5 | 0.008 | 0.008 | | |

TABLE 2

| Specimen No. | Steel No. | Heat treatment temperature (° C.) | Cooling rate (° C./s) | Average size of Cr-based carbonitrides (nm) | Amount of Cr-based carbonitrides (mass %) | Remarks |
|---|---|---|---|---|---|---|
| A1a | A1 | 1080 | 1.5 | 15 | 0.116 | Invention Example |
| A1b | A1 | 1080 | 7.0 | Cr-based carbonitrides were not detected | | Comparative Example |
| A2 | A2 | 1080 | 1.5 | 10 | 0.402 | Invention Examples |
| A3 | A3 | 1080 | 1.5 | 15 | 0.090 | |
| A4 | A4 | 1100 | 1.5 | 20 | 0.396 | |
| A5 | A5 | 1100 | 1.5 | 20 | 0.120 | |
| A6 | A6 | 1080 | 1.8 | 30 | 0.227 | |
| A7 | A7 | 1080 | 1.8 | 30 | 0.136 | |
| A8 | A8 | 1100 | 1.5 | 20 | 0.274 | |
| A9 | A9 | 1100 | 1.5 | 20 | 0.080 | |
| A10 | A10 | 1100 | 1.5 | 20 | 0.101 | |
| A11 | A11 | 1080 | 1.5 | 20 | 0.188 | |
| A12 | A12 | 1080 | 1.5 | 15 | 0.152 | |
| A13 | A13 | 1080 | 1.5 | 20 | 0.119 | |
| A14 | A14 | 1100 | 1.8 | 25 | 0.121 | |
| A15 | A15 | 1100 | 1.8 | 25 | 0.140 | |
| A16 | A16 | 1100 | 1.8 | 20 | 0.116 | |
| A17 | A17 | 1020 | 1.9 | 10 | 0.005 | |
| B1 | B1 | 1080 | 1.8 | 20 | 0.171 | Comparative Examples |
| B2 | B2 | 1080 | 1.8 | 30 | 0.259 | |
| B3 | B3 | 1100 | 1.5 | 30 | 0.270 | |
| B4 | B4 | 1100 | 1.5 | 20 | 0.686 | |
| B5 | B5 | 1100 | 1.5 | 20 | 0.194 | |
| B6 | B6 | 1080 | 1.5 | 20 | 0.167 | |
| B7 | B7 | 1080 | 1.5 | 10 | 0.014 | |

TABLE 3

| Specimen No. | In the atmosphere Tensile strength (MPa) | In the atmosphere Reduction of area (%) | In the hydrogen of 70 MPa Tensile strength (MPa) | In the hydrogen of 70 MPa Reduction of area (%) | Relative reduction of area (%) | Remarks |
|---|---|---|---|---|---|---|
| A1a | 712 | 79 | 720 | 73 | 92 | Invention Example |
| A1b | 625 | 81 | 618 | 77 | 95 | Comparative Example |
| A2 | 745 | 84 | 737 | 81 | 96 | Invention Examples |
| A3 | 709 | 80 | 699 | 74 | 93 | |
| A4 | 776 | 74 | 780 | 77 | 104 | |
| A5 | 711 | 79 | 713 | 70 | 89 | |
| A6 | 718 | 85 | 722 | 84 | 99 | |
| A7 | 704 | 80 | 711 | 79 | 99 | |
| A8 | 734 | 77 | 736 | 75 | 97 | |
| A9 | 729 | 80 | 717 | 80 | 100 | |
| A10 | 718 | 81 | 722 | 79 | 98 | |
| A11 | 725 | 79 | 716 | 80 | 101 | |
| A12 | 720 | 78 | 711 | 76 | 97 | |
| A13 | 703 | 75 | 704 | 70 | 93 | |
| A14 | 706 | 77 | 712 | 78 | 101 | |
| A15 | 712 | 80 | 709 | 75 | 94 | |
| A16 | 707 | 79 | 713 | 72 | 91 | |
| A17 | 672 | 80 | 680 | 79 | 99 | |
| B1 | 711 | 77 | 571 | 43 | 56 | Comparative Examples |
| B2 | 636 | 83 | 598 | 68 | 82 | |
| B3 | 720 | 81 | 531 | 39 | 48 | |
| B4 | 755 | 78 | 603 | 40 | 51 | |
| B5 | 707 | 80 | 542 | 45 | 56 | |
| B6 | 716 | 81 | 557 | 47 | 58 | |
| B7 | 569 | 84 | 570 | 85 | 101 | |

INDUSTRIAL APPLICABILITY

In the austenitic stainless steel of the embodiment, extremely excellent hydrogen embrittlement resistance characteristics in the high pressure hydrogen gas exceeding 40 MPa and a tensile strength exceeding 650 MPa are obtained. Therefore, the austenitic stainless steel of the embodiment can be applied to materials such as a high pressure hydrogen gas tank for storing a hydrogen gas having the pressure exceeding 40 MPa, a high pressure hydrogen gas tank liner, and piping for a high pressure hydrogen gas and liquid hydrogen.

The invention claimed is:

1. A high-strength austenitic stainless steel comprising, in terms of % by mass:

C: 0.2% or less;
Si: 0.3% to 1.5%;
Mn: 7.0% to 11.0%;
P: 0.06% or less;
S: 0.008% or less;
Ni: 5.0% to 10.0%;
Cr: 14.0% to 20.0%;
Cu: 1.0% to 5.0%;
N: 0.01% to 0.4%; and
O: 0.015% or less,
with the balance being Fe and unavoidable impurities,
wherein an average size of Cr-based carbonitrides is 100 nm or less, and an amount of the Cr-based carbonitrides is 0.001% to 0.5% in terms of % by mass.

2. The high-strength austenitic stainless steel according to claim 1, further comprising, in terms of % by mass, one or more selected from Mo: 0.5% or less, Al: 0.3% or less, Mg: 0.01% or less, Ca: 0.01% or less, REM: 0.10% or less, B: 0.005% or less, Ti: 0.5% or less, Nb: 0.5% or less, and V: 0.5% or less.

3. The high-strength austenitic stainless steel according to claim 1, which is used in a high pressure hydrogen gas and liquid hydrogen environment.

4. A method for producing a high-strength austenitic stainless steel, the method comprising:

a step of hot-working a semi-finished product having a component composition according to claim 1;
a step of performing a final heat treatment at a temperature of 1000° C. to 1150° C.; and
a step of performing cooling after the final heat treatment,
wherein, in the cooling step, an average cooling rate is controlled to be less than 2.0° C/s until the temperature reaches 750° C.;
thereby producing the high-strength austenitic stainless steel of claim 1.

5. The high-strength austenitic stainless steel according to claim 2, which is used in a high pressure hydrogen gas and liquid hydrogen environment.

6. A method for producing a high-strength austenitic stainless steel, the method comprising:

a step of hot-working a semi-finished product having a component composition according to claim 2;
a step of performing a final heat treatment at a temperature of 1000° C. to 1150° C.; and
a step of performing cooling after the final heat treatment,
wherein, in the cooling step, an average cooling rate is controlled to be less than 2.0° C/s until the temperature reaches 750° C.;
thereby producing the high-strength austenitic stainless steel of claim 2.

* * * * *